US007049736B2

(12) United States Patent
Suk et al.

(10) Patent No.: US 7,049,736 B2
(45) Date of Patent: May 23, 2006

(54) METHOD OF TRAPPING ACCELERATING ELECTRONS IN PLASMA

(75) Inventors: Hy-yong Suk, Changwon (KR); Guang-Hoon Kim, Busan (KR); Jong-Uk Kim, Changwon (KR); Chang-Bum Kim, Changwon (KR); Hae-June Lee, Eujungbu-Si (KR)

(73) Assignee: Korea Electrotechnology Research Institute, Changwon (KR)

( * ) Notice: Subject to any disclaimer, the term of this patent is extended or adjusted under 35 U.S.C. 154(b) by 124 days.

(21) Appl. No.: 10/364,653

(22) Filed: Feb. 12, 2003

(65) Prior Publication Data

US 2004/0195951 A1 Oct. 7, 2004

(51) Int. Cl.
*H05H 1/54* (2006.01)

(52) U.S. Cl. ..... 313/359.1; 315/111.81; 315/111.61; 313/362.1; 313/231.01

(58) Field of Classification Search ..... 313/231.01, 313/359.1, 362.1; 315/111.61, 111.81
See application file for complete search history.

(56) References Cited

U.S. PATENT DOCUMENTS 5,789,876 A 8/1998 Umstadter et al.

OTHER PUBLICATIONS

Tajima, T et al, Laser Electron Accelerator, Physical Review Letters, vol. 43, No. 4, Jul. 23, 1979.
Suk, H, et al, Plasma Electron Trapping and Acceleration in a Plasma Wake Field Using a Density Transition, Physical Review Letters, vol. 86, No. 6, Feb. 5, 2001.
Bulanov, S. et al, Particle Injection into the Wave Acceleration Phase Due to Nonlinear Wake Wave Breaking, Physical Review E, vol. 58, No. 5, Nov. 1998.

*Primary Examiner*—Mariceli Santiago
*Assistant Examiner*—Anthony T. Perry
(74) *Attorney, Agent, or Firm*—Lowe, Hauptman & Berner, LLP

(57) ABSTRACT

Background plasma electrons in a laser wake field are trapped and accelerated using a sharp downward density transition. A short and intense laser pulse travels through low density plasma with a sharp downward density transition. The density transition scale length is much smaller than the wavelength of a laser wake wave. As the laser wake wave passes the density transition, its wavelength increases suddenly so that some background plasma electrons are self-injected into the acceleration phase of the wake field and trapped and accelerated by the strong laser wake field.

16 Claims, 7 Drawing Sheets

(a)

(b)

(c)

METHOD OF TRAPPING ACCELERATING ELECTRONS IN PLASMA

TECHNICAL FIELD

This invention relates to a method and apparatus for trapping and accelerating electrons in plasma and, more particularly, to a method and apparatus for trapping and accelerating background plasma electrons to relativistic velocities.

BACKGROUND OF THE INVENTION

Methods of generation of high-energy electron beams have been investigated for the past several decades. Most common methods employ electromagnetic waves in the range of microwave or RF (Radio Frequency). However, this kind of conventional methods have a limit in acceleration gradient, which is approximately 20 MeV/m or so. As a result, high energy electron accelerators are generally big in size. Therefore, several new methods have been explored to overcome the limit in conventional accelerators. One of promising acceleration methods is to employ a plasma (See "Laser Electron Accelerator" by T. Tajima and J. M. Dawson in Phys. Rev. Lett. 43, 267 (1979)). So far several plasma-based advanced acceleration methods have been studied, but nothing is satisfactory yet.

SUMMARY OF THE INVENTION

One object of the present invention is to provide a method of and apparatus for trapping and accelerating background plasma electrons to relativistic velocities using a high power laser pulse and a plasma with a sharp downward density transition in a small volume.

The present inventors propose and demonstrate herein a novel method using a sharp downward plasma density and a laser pulse to generate high energy electron beams (See "Investigation of high-brightness electron beam generations by a laser wake field in a plasma with a sharp downward density transition" by H. Suk et al. (submitted to Phys. Rev. E for publication (2002)). This method looks similar to the electron beam-driven case (See "Plasma Electron Trapping and Acceleration in a Plasma Wake Field Using a Density Transition" by H. Suk et al., Phys. Rev. Lett. 86, 1011 (2001)) that was originally proposed by the present inventors. If the two methods are compared, there are some differences as physical mechanisms in generation of wake waves are different in both cases. Compared to the electron beam-driven case, the present laser-based method is much better in several points of view. First of all, the present laser method can employ a much higher plasma density as a high power laser pulse can be made very short easily. As a result, a much higher acceleration gradient can be achieved with the present laser-based method. Second, the present laser-based method is much better in terms of compactness and cost-effectiveness. Nowadays terawatt (TW) lasers can be made in a table-top size very easily and they are cost-effective, while the electron beam-based method is big in size and expensive as a high energy accelerator for driving electron beams consists of bulky and expensive components such as a klystron, modulator, electron gun, linear accelerator, waveguide, etc. Thus, the laser-based method and apparatus of the present invention can offer a novel and cost-effective way of generating high-energy electron beams in a compact size.

Other objects and advantages of the present invention will become apparent from the following description and accompanying drawings.

DETAILED DESCRIPTION OF THE DRAWING

Figure 1:
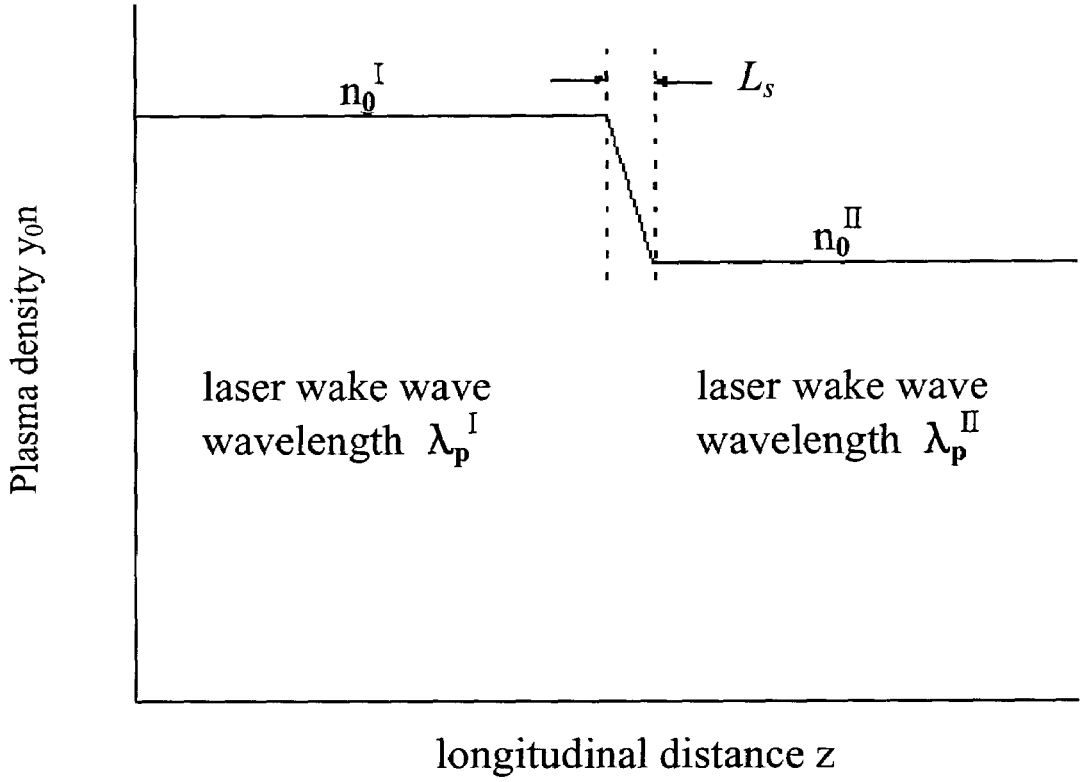
FIG. 1 is a schematic of a plasma density profile with a sharp downward density gradient.

The present invention provides a method of trapping and accelerating plasma electrons comprising the steps of generating a plasma wave in a plasma, wherein the plasma contains a first plasma, a second plasma and a sharp downward density transition between the first plasma and the second plasma; generating a wake field in the plasma; propagating the wake field through the first plasma towards the second plasma; trapping background electrons of the plasma in the wake field; and accelerating the trapped background electrons to relativistic velocities.

In one embodiment of the present invention, the density of the first plasma must be higher than the density of the second plasma. Moreover, the wake field may be generated by an intense laser pulse and the background electrons may be self-injected into the acceleration phase of the wake field by directing the laser beam to the density transition.

Furthermore, the background electrons may be formed from the neutral gas by the laser pulse at an intensity sufficient to remove the electrons from the gas atoms thereby providing the background electrons.

In another embodiment of the present invention, the laser wake field is strong enough to expel most of the background electrons of the plasma from the path the laser beam will propagate.

In another embodiment of the present invention, the intense laser pulse may comprise a CPA (chirped pulse amplification) laser.

In another embodiment of the present invention, the length of the laser pulse is almost equal to the wavelength of the laser wake wave.

In another embodiment of the present invention, the sharp downward density gradient can be formed by blocking a gas flow from a single gas jet with a thin wire (diameter<<plasma wavelength $\lambda_p$), or the density transition may be produced by an ultrathin foil separating two different gas pressures from a double gas jet thereby increasing the wavelength of the laser wake wave itself. Furthermore, the background electrons are trapped in the laser wake wave during the wavelength of the laser wake wave increases.

In another embodiment of the present invention, the laser wake wave propagates through a magnetic field thereby separating the trapped electrons from the laser wake wave itself.

The present invention provides an apparatus for trapping and accelerating background electrons comprising means for generating an intense laser pulse; means for generating a plasma; and means for trapping the background electrons in the plasma and accelerating the trapped background electrons; and means for separating the trapped background electrons from the laser pulse. Moreover, the apparatus of the present invention may further comprise means for transporting the laser pulse from the pulse generating means to and through the plasma. Moreover, the means to generate the laser pulse may comprise a chirped pulse amplification (CPA) system.

In another embodiment of the present invention, the means for generating the plasma may comprise a laser photo-ionization means and a gas with two different densities to be ionized.

In another embodiment of the present invention, the plasma may contain a first plasma, a second plasma and a sharp downward density transition between the first plasma and the second plasma. Moreover, sharp downward density transition may be generated by blocking a gas flow from a single gas jet with a thin wire (diameter<<plasma wavelength) or by separating two different gas pressures in a double gas jet with an ultrathin foil.

In another embodiment of the present invention, the density of the first plasma must be higher than the density of the second plasma. Moreover, the intense laser wake wave may pass through the density transition, thereby increasing the wavelength of the laser wake wave itself and trapping the background electrons of the plasma. Moreover, the apparatus of the present invention may further comprise a magnetic field wherein the trapped background electrons are separated from the laser wake wave.

FIG. 1 is a schematic of a plasma density profile with a sharp downward density gradient.

It is well known that a wake wave generates a very strong longitudinal electric field wherein the field·strength is approximately given by the one-dimensional nonrelativistic limit $$E_z = \frac{m_e c \omega_p}{e},$$

where $m_e$ is the electron mass, c is the light speed in free space, $\omega_p$ is the plasma oscillation period, and e is the electron charge. If the laser wake wave propagates through a sharp downward density transition with the density transition scale length $L_s \ll \lambda_p$, the wavelength of the laser wake increases suddenly after passing the density gradient, i.e., $$\frac{\lambda_p^{II}}{\lambda_p^{I}} = \left(\frac{n_0^{I}}{n_0^{II}}\right)^{\frac{1}{2}}$$

Figure 2:
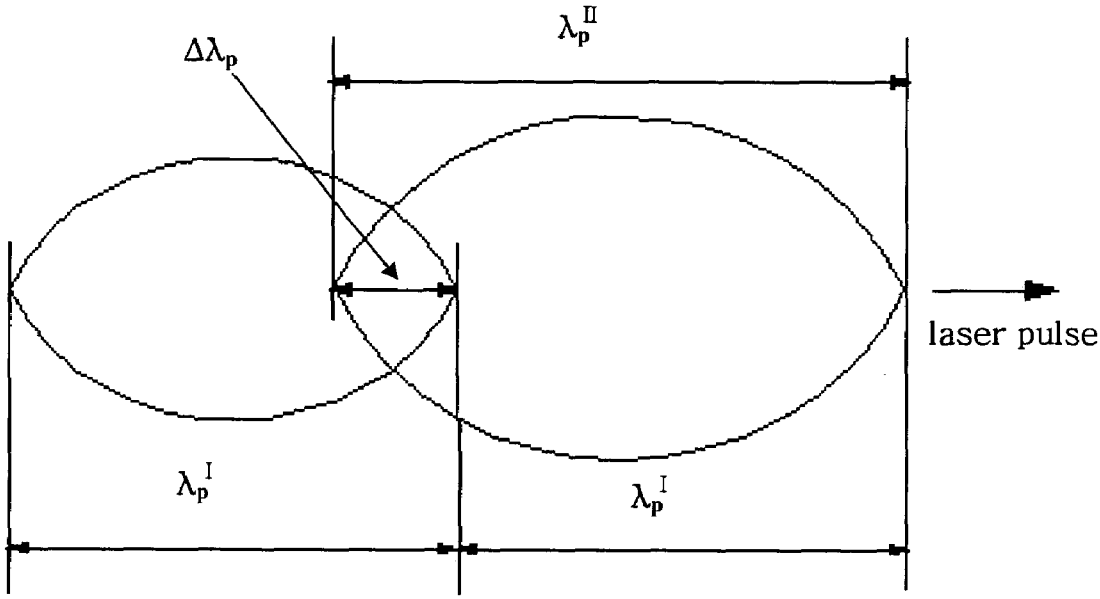
FIG. 2 is a schematic which shows that some plasma electrons in the node of the wake wave are self-injected into the acceleration phase of a laser wake field due to sudden increase of $\lambda_p$

(See FIG. 2). Therefore, plasma electrons in the node of the wake wave are transversely self-injected into the acceleration phase of the laser wake field. The self-injected plasma electrons are trapped by the very strong longitudinal laser wake field and accelerated to a relativistic velocity. These process is shown in the computer simulation result (see FIG. 3).

Figure 3:
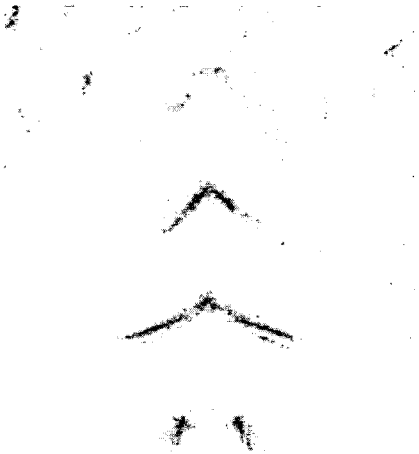
FIG. 3 is a plot in a phase space (r, z) showing that some background electrons are trapped and accelerated by a laser wake field of the present invention.
Figure 3:
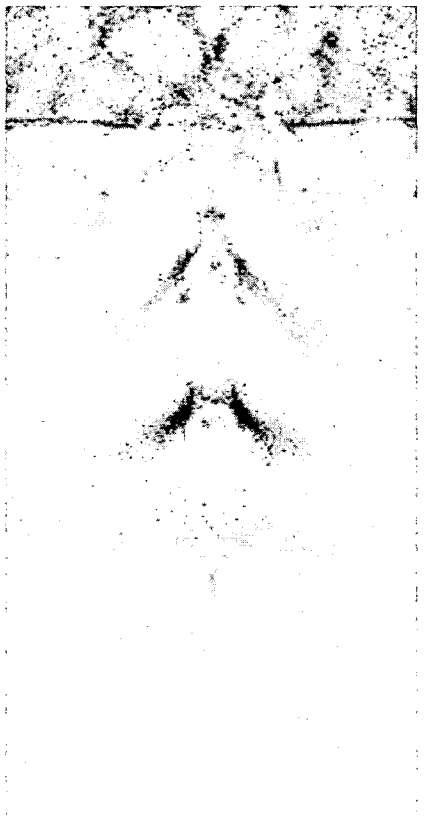
Figure 3:
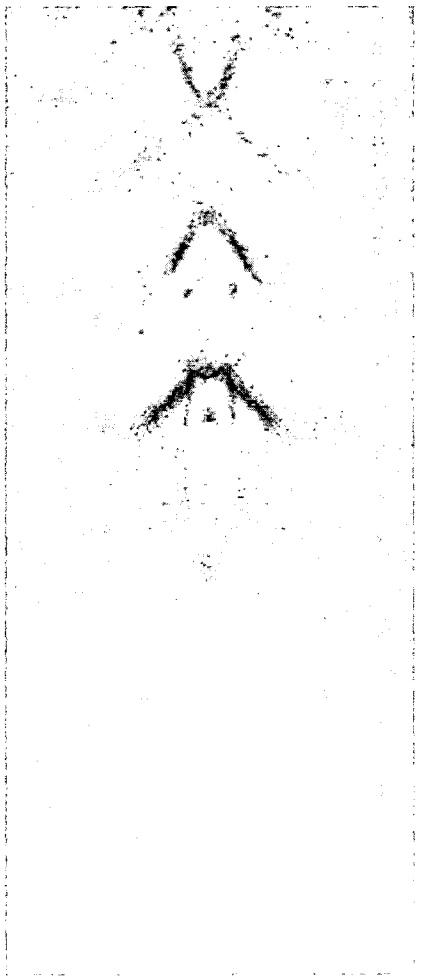
Figure 4:
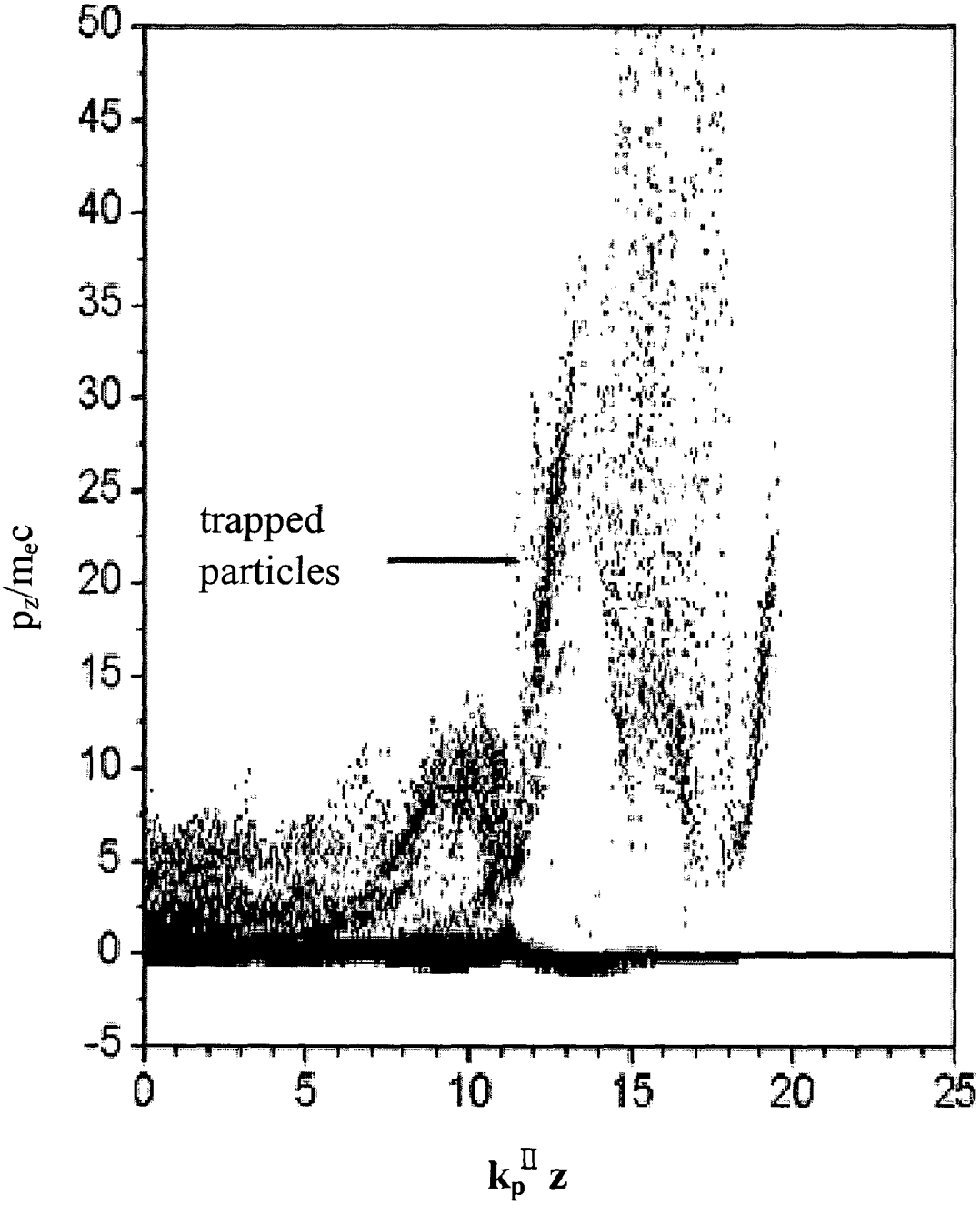
FIG. 4 is a plot in a momentum phase space ($p_z$, z) showing that the trapped background electrons are accelerated to a relativistic velocity by a laser wake field of the present invention.

In FIG. 3, the laser pulse is sent through a plasma with a density transition of $n_{(\ )}^{I}=5\times10^{18}$ cm$^{-3}$ and $n_{(\ )}^{II}=0.7n_{(\ )}^{1}$. FIG. 4(*a*) illustrates that some plasma electrons are injected transversely into the acceleration phase of the first plasma wave period. As the trapped electrons are being accelerated, the space charge force is gradually reduced. Consequently, the beam size of the trapped electrons decreases as propagating into the wake field (see FIG. 3(*b*) and FIG. 3(*c*)). The trapped electrons are rapidly accelerated to a relativistic velocity in a distance of $$\frac{c}{\omega_p}.$$

In this manner, the self-injection occurs locally in the plasma wave, and the trapped electrons occupy relatively small phase space in the plasma wave. Consequently, the accelerated high-energy electrons are well separated from the untrapped background plasma electrons (See FIG. 4) and the energy spread of the accelerated electrons becomes relatively small compared to the conventional self-injection type accelerating methods.

In addition to the longitudinal acceleration, the trapped particles are transversely focused by the background ions; the focusing force of the ions is $$F_r = \frac{e n_0 r}{2\varepsilon_0},$$

where r is the distance from the axis and $\varepsilon_{(\ )}$ is the permittivity of free space. It should be noted that the focusing force is linear to r, which can avoid an emittance growth during acceleration in the ion channel.

Figure 5:
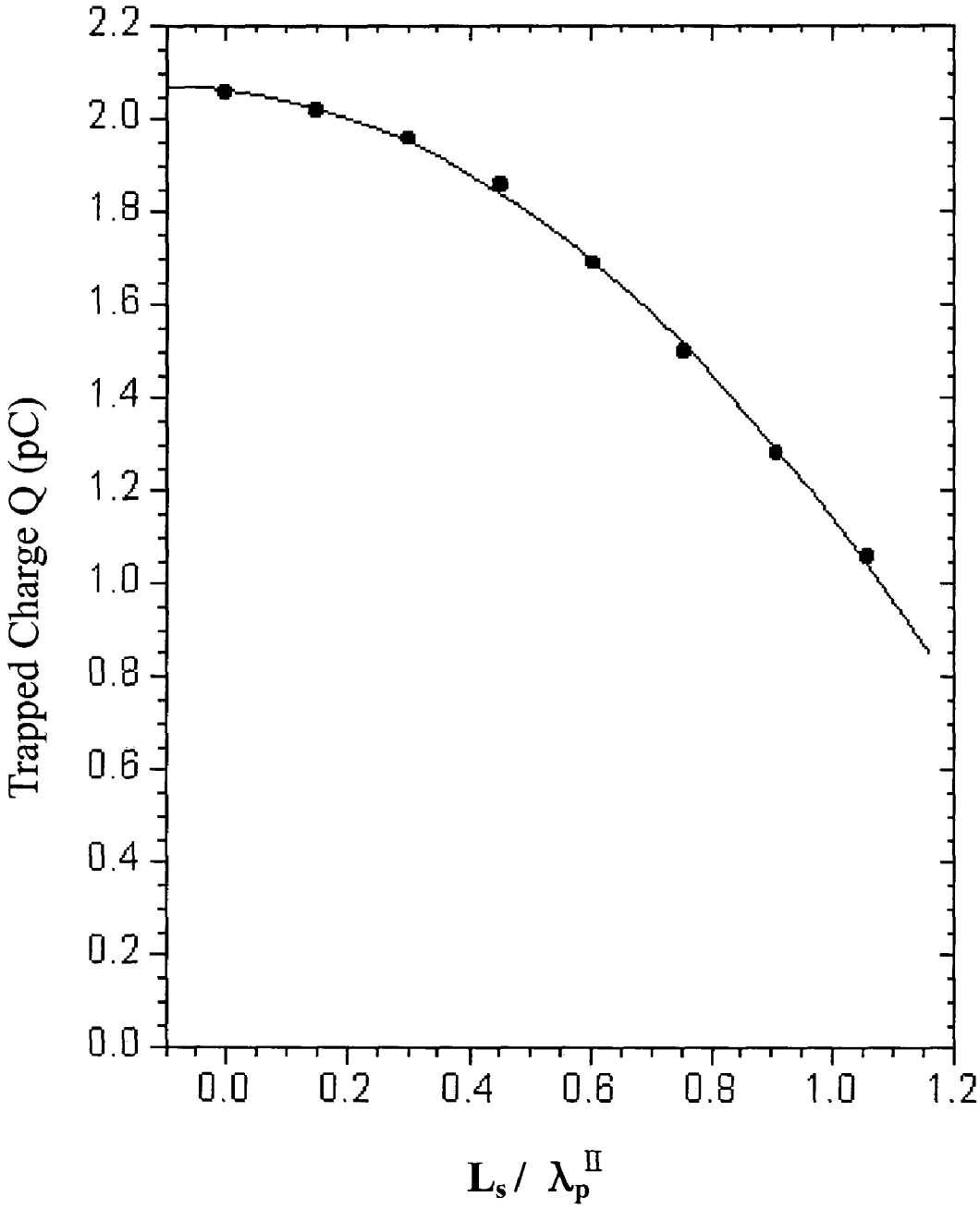
FIG. 5 is a plot showing the relation between the charge of the trapped background electron and the density gradient scale length.

The density transition scale length affects the number of trapped electrons. Computer simulations show that the charge of the trapped electrons is reduced by approximately 50% as $$\frac{L_S}{\lambda_P}$$

approaches 1 (See FIG. 5). In the simulation example given here, the plasma having the density of about $10^{18}$ cm$^{-3}$ is employed. As the density of the plasma becomes lower, the charge of the trapped electrons increases as $$\lambda_p \propto \frac{1}{\sqrt{n_0}}.$$

The simulation result also shows that the trapped electrons can not be accelerated indefinitely due to several reasons including dephasing, laser beam diffraction, laser energy depletion, etc. If the electron beam energy saturates, the beam should be ejected out of the plasma. If the drive laser pulse comes out of the plasma, the trapped electrons also comes out of the plasma, while the untrapped background electrons are just oscillatory and remain within the plasma.

Figure 6:
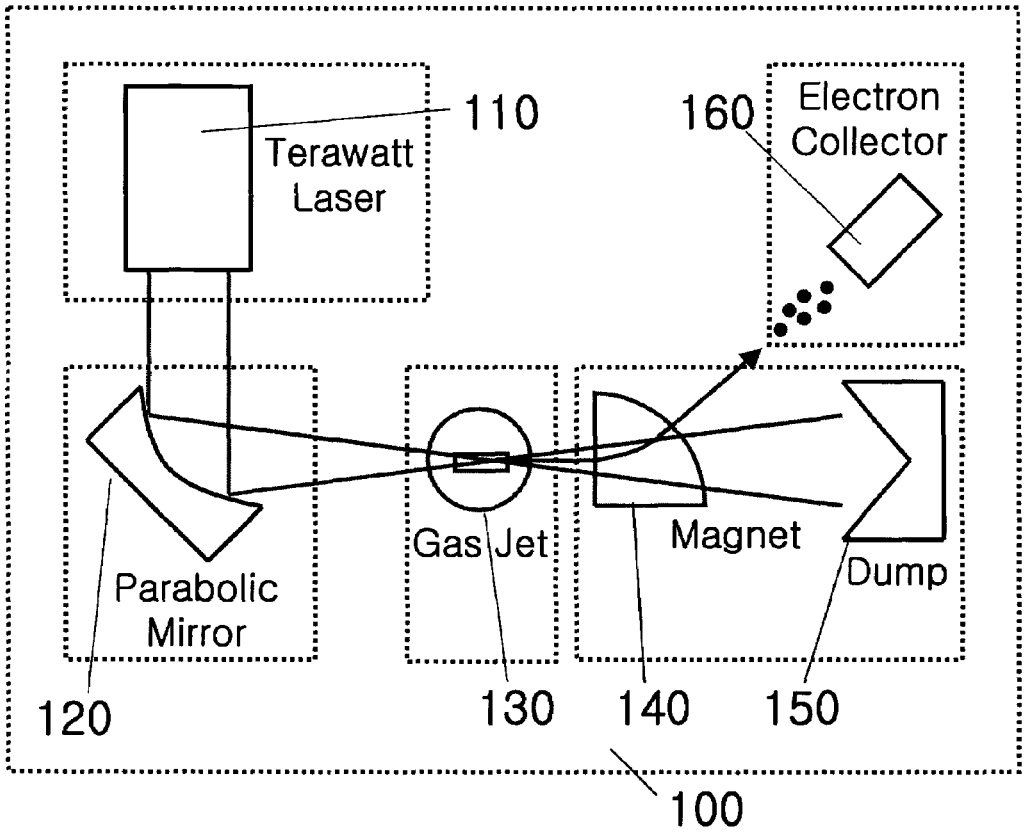
FIG. 6 is a schematic diagram of an example of an experimental electron accelerating system of the present invention.

FIG. 6 is a schematic diagram showing an example for the experimental particle accelerating system of an embodiment of the present invention.

The electron accelerating system of the present invention shown in FIG. 6 comprises means for generating an intense laser pulse 110; means for transporting the laser pulse from the laser generating means to and through the plasma 120; means for generating a plasma 130; means for trapping the background electrons in the plasma and accelerating the trapped background electrons 130; means for separating the trapped background electrons from the laser pulse 140; means to dump the laser pulse from which the trapped and accelerated electrons are separated 150; and means for collecting the accelerated electrons 160.

The system shown in FIG. 6 is for generating and accelerating an electron beam to relativistic velocity using a laser and a plasma; wherein the electrons of the plasma background is self-trapped into the laser wake wave by a sharp downward density transition formed by blocking a gas flow from a gas jet with a thin wire or by separating two different gas pressures with an ultrathin foil. Then the trapped electrons are accelerated by the laser wake field to relativistic velocity.

In one embodiment of the present invention, the means for generating an intense laser 110 may include a terawatt (TW) laser system. Moreover, the terawatt laser system may employ a chirped pulse amplification (CPA) method.

The optical means 120 focuses the above laser pulse into the plasma thereby generating a very strong wake field.

The means for trapping and accelerating electrons 130 can comprise a gas jet and thin wire or a gas jet and very thin foil. The details of the structure will be described below.

The means for separating the accelerated electrons from the laser pulse 140 may include a dipole magnet, in which the trapped and accelerated electrons are separated from the laser pulse by the magnetic field of the dipole magnet. The separated electrons propagate to the electron collector 160, and the laser pulse propagates straight and is dumped at the dump 150.

Figure 7:
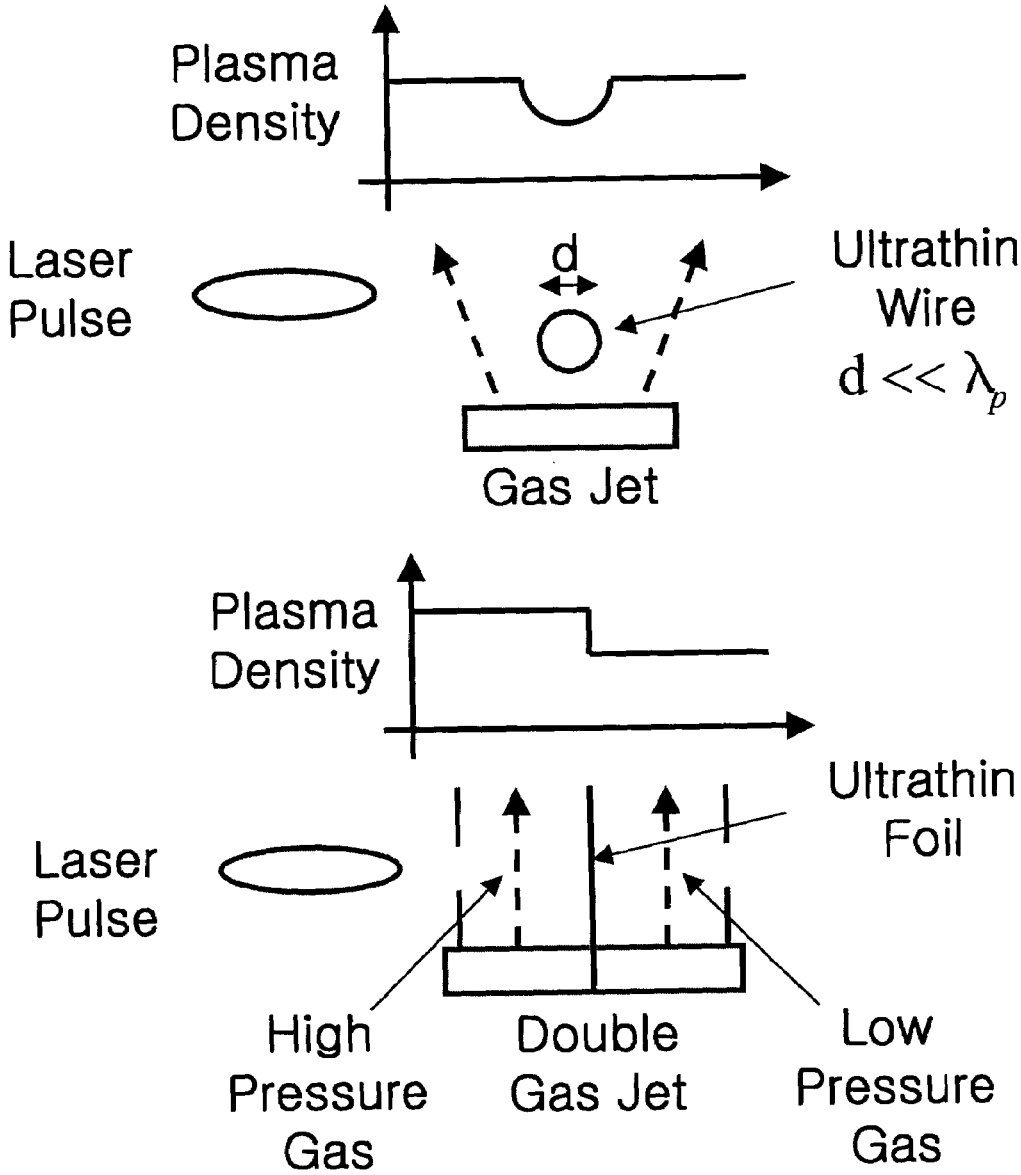
FIG. 7(*a*)~(*b*) are schematic representations showing an example for producing a sharp downward density transition. The sharp downward density transition may be produced by a thin wire blocking a gas flow from a single gas jet (see FIG. 7(*a*)) or it may be produced by an ultrathin foil separating two different gas pressures from a double gas jet (see FIG. 7(*b*)).

FIG. 7 (*a*)~(*b*) are detailed schematic representations of an example to produce a sharp downward density transition. In order to generate such a density transition, two different examples are shown in FIG. 7(*a*) and FIG. 7(*b*). In the first example, a thin wire is placed in front of a single gas jet so that a local downward density transition can be produced. In another example shown in FIG. 7(*b*), an ultrathin foil may be used to separate two different gas pressures in a double gas jet. In this manner, a sharp plasma density transition can be made and some plasma electrons can be trapped and accelerated to high energies by the laser wake field when an intense TW laser beam is passed.

From the foregoing detailed description of specific embodiments of the invention, it should be apparent that an improved method and apparatus for trapping and accelerating background plasma electrons in a plasma wake field has been disclosed. Although specific embodiments of the invention have been disclosed in some detail, these have been done solely for the purpose of illustrating various aspects and features of the invention, and are not intended to be limiting with respect to the scope of the invention. One skilled in the art will immediately recognize upon reading this disclosure that several other modifications could be made to the disclosed method and apparatus that are consistent with the inventive nature of the disclosed subject matter. It is therefore contemplated that various substitutions, alterations, and/or modifications may be made to the disclosed embodiment without departing from the spirit and scope of the invention as defined in the appended claims.

What is claimed is:

1. A method of trapping and accelerating plasma electrons in a plasma including a first plasma, a second plasma and a sharp downward density transition between the first plasma and the second plasma, the method comprising the steps of:

generating a wake field in the plasma by irradiating the plasma with a laser pulse;

propagating the wake field through the first plasma, thence to the second plasma;

trapping into the wake field background electrons of the plasma; and accelerating the trapped background electrons to a relativistic velocity.

2. The method of claim 1, wherein the density of the first plasma is higher than the density of the second plasma.

3. The method of claim 1, further including self-injecting the background electrons into the acceleration phase of said wake field by causing a beam of the laser pulse to be incident on the plasma.

4. The method of claim 1, wherein the laser pulse has an intensity high enough to push the background electrons strongly, thereby providing a wake wave.

5. The method of claim 1, wherein the plasma electrons are formed from gas atoms by the laser pulse at an intensity sufficient to remove the electrons from the atoms, thereby providing the background plasma electrons.

6. The method of claim 1, wherein the laser generated wake field is strong enough to expel most of the background electrons of the plasma from a beam propagation path of the laser pulse.

7. The method of claim 1, wherein the laser pulse is a chirped pulse amplification laser.

8. The method of claim 1, wherein the laser pulse is generated by a laser and the laser pulse has a length almost equal to the wavelength of the wake wave generated by the laser.

9. The method of claim 1, further including forming the sharp downward density transition by blocking gas flow from a single gas jet with a thin wire or by separating different gas pressures in a double gas jet with an ultrathin foil.

10. The method of claim 9, further including increasing the wavelength of a laser wake wave associated with the wake field by causing the laser wake wave to pass the sharp downward density transition.

11. The method of claim 10, further including trapping background electrons in the wake wave associated with the wake field and generated by the laser during increases of the wavelength of the wake wave generated by the laser.

12. The method of claim 1, further including causing the wake wave to propagate through a magnetic field, thereby separating the trapped electrons from a beam of a laser that caused the laser pulse to be generated.

13. The method of claim 12, further including collecting the electrons separated from the laser beam with an electron beam collector.

14. The method of claim 1, wherein the laser pulse is such that the trapped electrons are accelerated to a relativistic velocity in a distance c/Wp, where c is the speed of light in free space and Wp is the plasma oscillation period.

15. The method of claim 1, wherein the laser pulse is derived from a terawatt laser.

16. The method of claim 15, wherein the laser pulse is such that the trapped electrons are accelerated to a relativistic velocity in a distance c/Wp, where c is the speed of light in free space and Wp is the plasma oscillation period.

* * * * *